US011653770B2

(12) United States Patent
Grothaus

(10) Patent No.: US 11,653,770 B2
(45) Date of Patent: May 23, 2023

(54) POCKET SPRING CORE AND METHOD FOR PRODUCING THE SAME

(71) Applicant: AGRO Holding GmbH, Bad Essen (DE)

(72) Inventor: Sabine Grothaus, Bad Essen (DE)

(73) Assignee: AGRO Holding GmbH, Bad Essen (DE)

( * ) Notice: Subject to any disclaimer, the term of this patent is extended or adjusted under 35 U.S.C. 154(b) by 28 days.

(21) Appl. No.: 16/636,979

(22) PCT Filed: Jul. 25, 2018

(86) PCT No.: PCT/EP2018/070087
§ 371 (c)(1),
(2) Date: Feb. 6, 2020

(87) PCT Pub. No.: WO2019/029988
PCT Pub. Date: Feb. 14, 2019

(65) Prior Publication Data

US 2020/0367662 A1 Nov. 26, 2020

(30) Foreign Application Priority Data

Aug. 7, 2017 (DE) ..... 10 2017 117 833.3

(51) Int. Cl.
*A47C 27/06* (2006.01)
*A47C 27/07* (2006.01)
(Continued)

(52) U.S. Cl.
CPC ..... *A47C 27/064* (2013.01); *A47C 27/07* (2013.01); *B68G 7/00* (2013.01); *B68G 9/00* (2013.01)

(58) Field of Classification Search
CPC ... A47C 27/064; A47C 27/067; A47C 27/066; A47C 27/06; A47C 27/063; A47C 27/07; A47C 27/062; B68G 7/00
See application file for complete search history.

(56) References Cited

U.S. PATENT DOCUMENTS 5,868,383 A * 2/1999 Codos ..... F16F 3/04 267/80
8,011,046 B2 9/2011 Stjerna
(Continued)

FOREIGN PATENT DOCUMENTS

DE 29705098 U1 10/1997
DE 19823845 A1 12/1999
(Continued)

OTHER PUBLICATIONS

International Search Report of PCT/EP2018/070087 dated Sep. 17, 2018.
(Continued)

*Primary Examiner* — David R Hare
*Assistant Examiner* — Amanda L Bailey
(74) *Attorney, Agent, or Firm* — Collard. & Roe, P.C.

(57) ABSTRACT

A pocket spring core as well as a method for producing a pocket spring core for use in the manufacture of mattresses or furniture upholstery. The pocket spring core has a plurality of springs, a number of which lie in a row one behind the other in respective flexible pockets, forming a bank of springs, and a number of adjacent banks of spring, which together form a supporting surface, are interconnected. The springs of at least one region of the supporting surface have different springing characteristics from the springs of the neighboring regions. At least one part of the individual banks of springs consists of bank portions with differing spring characteristics, the pocketed springs of each bank portion are identical, at least some of the neighboring
(Continued)

portions of adjacent banks of springs are of different lengths and the neighboring portions of adjacent banks of springs are interconnected.

3 Claims, 1 Drawing Sheet

(51) Int. Cl.
*B68G 9/00* (2006.01)
*B68G 7/00* (2006.01)

(56) References Cited

U.S. PATENT DOCUMENTS 8,895,109 B2 * 11/2014 Blanga Cohen ..... A47C 27/056 427/331
9,332,856 B2 * 5/2016 Eigenmann ..... A47C 7/746
10,104,970 B1 * 10/2018 Stiles ..... A47C 7/34
2004/0103479 A1 * 6/2004 Mossbeck ..... A47C 23/0433 5/720
2004/0128773 A1 * 7/2004 Barber ..... F16F 1/08 5/716
2005/0257323 A1 * 11/2005 Edling ..... B68G 9/00 5/720
2007/0130883 A1 * 6/2007 Takahashi ..... B21F 27/16 53/285
2010/0212090 A1 * 8/2010 Stjerna ..... A47C 27/064 5/720
2012/0102658 A1 * 5/2012 Mantzis ..... A47C 27/062 5/720
2014/0201924 A1 * 7/2014 Wolfson ..... B29C 66/729 5/720
2016/0029809 A1 * 2/2016 Shive ..... A47C 27/05 5/718
2016/0166076 A1 * 6/2016 Mossbeck ..... A47C 27/065 5/720
2017/0035211 A1 * 2/2017 Alletto, Jr. ..... A47C 27/062
2017/0251821 A1 * 9/2017 Long ..... B29C 65/48
2018/0049559 A1 * 2/2018 Jewett ..... A47C 27/066
2018/0055240 A1 * 3/2018 DeMoss ..... A47C 27/062
2019/0269251 A1 * 9/2019 Eigenmann ..... A47C 27/062
2019/0274444 A1 * 9/2019 Grothaus ..... B68G 9/00
2020/0178698 A1 * 6/2020 Albæk ..... A47C 27/064
2020/0288874 A1 * 9/2020 Jewett ..... A47C 27/15
2020/0390248 A1 * 12/2020 Ghanei ..... A47C 27/14
2021/0045540 A1 * 2/2021 Jewett ..... A47C 7/34
2021/0078855 A1 * 3/2021 Fischer ..... A47C 27/062
2021/0087050 A1 * 3/2021 Fischer ..... A47C 27/002

FOREIGN PATENT DOCUMENTS

EP 0089789 A1 9/1983
JP 2001340175 A 12/2001
WO 9635355 A1 11/1996
WO 2007102772 A1 9/2007

OTHER PUBLICATIONS

German Office Action dated May 17, 2018 issued in corresponding German Application 10 2017 117 833.3 (with English translation of relevant parts).

* cited by examiner

POCKET SPRING CORE AND METHOD FOR PRODUCING THE SAME

CROSS REFERENCE TO RELATED APPLICATIONS

This application is the National Stage of PCT/EP2018/070087 filed on Jul. 25, 2018, which claims priority under 35 U.S.C. §119 of German Application No. 10 2017 117 833.3 filed on Aug. 7, 2017, the disclosures of which are incorporated by reference. The international application under PCT article 21(2) was not published in English.

BACKGROUND OF THE INVENTION

The invention relates to a pocket spring core according to the preamble of claim 1 as well as a method for producing a pocket spring core.

Such spring cores are used in many areas of application. They are primarily used in the manufacture of mattresses or furniture upholstery.

In particular, in order to achieve sufficient edge stability, which is desired when the cushion or mattress is used as a seating area, it is known to provide the spring core with an upper and lower circumferential edge reinforcement consisting of a round or flat material, preferably metal.

Such a spring core is known for example from WO 96/35 355 A1. However, this spring core cannot be rolled up and unrolled, so that it does not meet the requirements for optimized production.

In order to finish the mattress or upholstered part as an end product, the spring cores usually have to be transported from the place of manufacture to the mattress production, wherein the respective production sites can be very far apart.

Since the spring cores take up a relatively large volume with low weight due to their nature in the position of use, the transport costs of these spring cores are disproportionately high.

In order to achieve a different zoning in their suspension behavior, also for the above-mentioned edge reinforcement, without a circumferential metal frame, banks of springs are used whose springs are harder than those of neighboring banks of springs. This is achieved by various selection criteria, e.g. by deviating wire diameters or by changes in the number of turns. Even a selection of different material properties can cause a correspondingly changed spring behavior, as can waist formation of the individual springs.

In the mechanical production of banks of springs, banks of springs can only ever be equipped with the same springs. In order to assemble banks of springs with partially different springs to a spring core, wherein, according to the generic design, adjacent banks of springs are connected to each other, a previously described frame is used which encloses the spring core completely. The banks of springs, of which at least one part consists in a manner of speaking of individual banks of springs which differ in their spring behavior, extend in the longitudinal direction of a rectangular elongated spring core. This means that the partial banks of springs of a bank of springs add up to the total length of the spring core.

Apart from the fact that the described problems arise when fixing the partial banks of springs by means of a metal frame, a complete mechanical production of the spring core is not possible and therefore no automation, since the circumferential metal frame must be fixed manually after joining and connecting the adjacent banks of springs.

All in all, the generic prior art is extremely unsatisfactory, especially with regard to cost optimization, which is always the goal.

The invention is based on the object of developing a pocket spring core of the generic type as well as a method for manufacturing such a pocket spring core in such a way that mechanical automatic production of the spring core is possible overall and cost optimization is achieved.

SUMMARY OF THE INVENTION

This object is solved by a spring core with the features of claim 1 and a method for producing the spring core.

The invention now creates the possibility of creating any number of different zonings of the spring core by either mechanically producing banks of springs with the same springs or partial banks of springs, depending on the claim, each with different spring characteristics of the individual springs, which are then joined together in further method steps in such a way that banks of springs with regionally different spring behavior result. The individual springs of a partial bank of springs are identical in their spring characteristics.

In a manner known per se, this spring characteristic can be influenced, for example, by the material selection of the spring wire, the wire diameter and the spring shape; the latter, for example, as a waisted, cylindrical or barrel-shaped design.

The new pocket spring core offers clear advantages over a prior art spring core in terms of manufacturing costs, handling and freedom of design.

As mentioned, the production of the new pocket spring core can take place fully automatically, i.e. mechanically, with regard to both the production of the partial banks of springs, their assembly to form a thus complete pocket spring core, and the interconnection of adjacent springs with different pocket springs in terms of their spring characteristics.

In addition, individual production of pocket spring cores is possible, depending on the needs of the future user. This includes the consideration of the suspension behavior of different zones. This means, for example, that one-sided, multi-sided or circumferential edge reinforcement is possible without any problems with correspondingly harder spring characteristics. Likewise, preferred zones within the lying surface can be individually adapted during the production of the pocket spring core and, due to the automated production process, are essentially cost-neutral.

The absence of a circumferential metal frame also makes further processing of the pocket spring core into a mattress or padding that can be used in other ways unproblematic, especially with regard to transport from the pocket spring core production plant to the processing plant. This is mainly due to the fact that the pocket spring core can be rolled up and thus only requires a small amount of transport space, which also contributes to cost optimization.

In principle, the invention according to which partial banks of springs of adjacent banks of springs are of different lengths and these adjacent partial banks of springs are connected to each other creates a meshing from which a firm connection of all banks of springs results, although the partial banks of springs with different spring behavior of a bank of springs cannot be connected to each other, at least not mechanically, as is possible with the connection of several adjoining banks of springs.

In a manner known per se, the parallel juxtaposition of the partial banks of springs can be achieved by gluing or welding, which also takes place just as mechanically as the production of the partial banks of springs.

The method for the mechanical production of a pocket spring core is, in accordance with the invention, designed in such a way that first at least a part of the banks of springs are produced as partial banks of springs with different spring behavior in different lengths, then adjoining partial banks of springs are connected to one another, wherein partial banks of springs with different spring characteristics overlap with their free end, so to speak, and are likewise connected to one another in this overlap region.

DETAILED DESCRIPTION OF THE EMBODIMENTS

Figure 1:
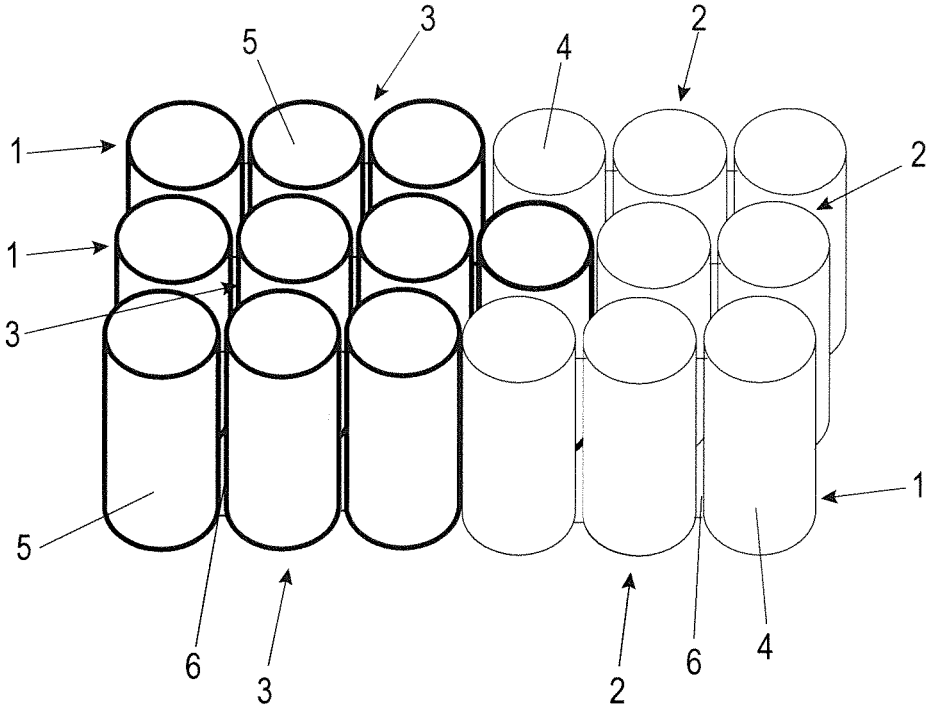
FIG. 1 shows a schematic illustration of a section of a pocket spring core according to the invention in perspective view.

The figures each show a section in the region of a corner of a pocket spring core, having a plurality of pocketed springs 4, 5, of which several form a bank of springs 1 arranged one behind the other in a row, wherein the springs 4, 5 each lie in a flexible pocket, preferably formed from textile material. These pockets are connected to each other by webs 6.

Several of the banks of springs 1, which are arranged side by side and connected to each other, for example by gluing or welding, form a lying surface, wherein the length of the banks of springs 1 correspond to the length of the rectangular lying surface.

In the example shown, the individual banks of springs 1, disposed in parallel next to each other, are each formed by partial banks of springs 2, 3, whose spring behavior is different, which is illustrated in the figures by the different line widths of the pocketed springs 4, 5.

According to the invention, the partial banks of springs 2, 3 are of different lengths, in the examples by one spring 4, 5 each.

Figure 2:
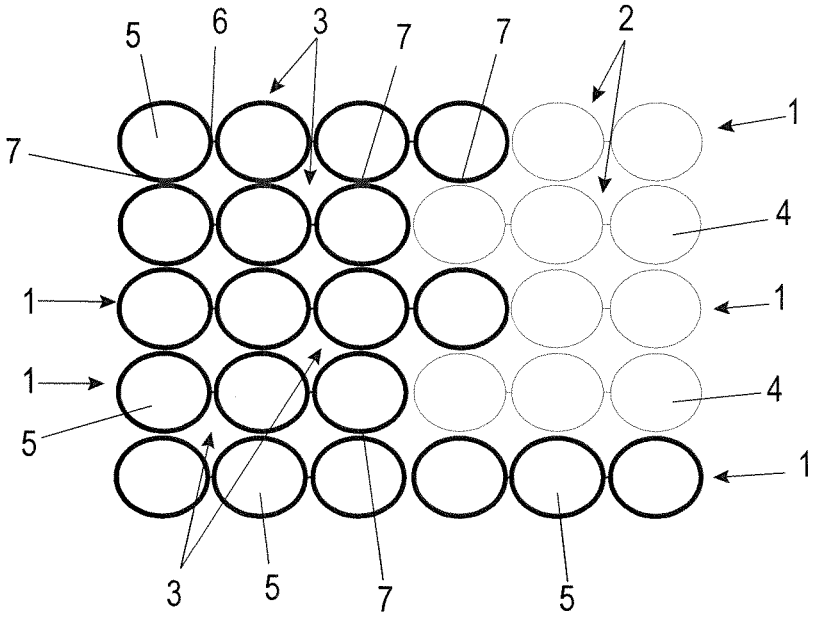
FIG. 2 shows a schematic illustration of a section of another example of a pocket spring core according to invention in a plan view.

Since the length of the individual banks of springs 1 is the same, the connecting region of the partial banks of springs 2, 3 leads to meshing, i.e. according to the example in FIG. 2, a shorter partial bank of springs 3 is arranged between two longer partial banks of springs 3, so that the partial bank of springs 3 completing the bank of springs 1 projects between the two longer partial banks of springs 3 and, like the short partial bank of springs 3, is fastened to the longer partial banks of springs 3 on both sides in the region of a connection point 7. In addition, all adjoining banks of springs 1 are connected to each other in the waist area of their individual springs 4, 5 or at their pockets.

In the variant of the invention shown in FIG. 2, the lower bank of springs 1 forming an outer edge of the lying surface in the drawing plane is continuously equipped with the same springs 5 and thus forms an edge reinforcement, as also the angled row of adjoining springs 5 resulting from the last spring 5 of the adjoining banks of springs 1, wherein this edge reinforcement can be circumferential.

The springs 5 shown in the figures with larger line widths are harder in their spring characteristics than the springs 4 shown with smaller line widths.

The arrangement of the partial banks of springs 2, 3, depending on the desired spring behavior of the corresponding areas of the spring core, can be selected at will and only depends on the customer's requirements.

What is claimed is:

1. A pocket spring core, having a plurality of springs (4, 5), of which a plurality thereof arranged one behind the other in a row and each lying in a flexible pocket formed of textile material form an individual bank of springs (1) and a plurality of adjoining banks of springs (1) which jointly form a lying surface are connected to one another, wherein the springs (4, 5) of at least one region of the lying surface are different in their spring behavior with respect to the springs (4, 5) of adjacent regions wherein:

at least some of the individual banks of springs (1) consist of partial banks of springs (2, 3) with different spring behavior, the pocketed springs (4, 5) of the respective partial banks of springs (2, 3) have the same spring behavior, the adjoining banks of springs (1) comprise adjacent partial banks of springs (2, 3), at least some of the adjacent partial banks of springs (2, 3) of adjoining banks of springs (1) are of different lengths, the adjacent partial banks of springs (2, 3) of adjoining banks of springs (1) that have a the same spring behavior are directly connected to one another by gluing or welding, and the partial banks of springs having different spring behavior within an individual bank of springs are not directly connected to each other, and wherein a further partial bank of springs (2, 3) of a further bank of springs (1) is arranged between two partial banks of springs (2, 3) of two of the banks of springs (1), wherein the further partial bank of springs (2,3) has a length that is different than a length of the partial banks of springs (2, 3) adjacent on both sides of the further partial bank of springs, so that at least one individual spring (4,5) of the further partial bank of springs (2,3) is adjacent springs (4,5) of a different spring behavior in the adjacent partial banks of springs and the at least one individual spring is directly connected to the springs of a different spring behavior in the adjacent partial banks of springs (2, 3).

2. The pocket spring core according to claim 1, wherein the banks of springs (1) correspond in their length to the length of the pocket spring core formed as a rectangle.

3. A method for the mechanical production of a pocket spring core according to claim 1, comprising first producing the partial banks of springs (2, 3) of different lengths, then directly connecting these adjoining partial banks of springs (2, 3) to one another by gluing or welding.

* * * * *